US006297744B1

(12) United States Patent
Baillargeon et al.

(10) Patent No.: US 6,297,744 B1
(45) Date of Patent: Oct. 2, 2001

(54) AERIALIFT WARNING SYSTEM AND METHOD

(76) Inventors: Paul D. Baillargeon, 103 Horse Corner Rd., Chichester, NH (US) 03234; Gabor L. Szakacs, 219 Coburn Woods, Nashua, NH (US) 03063; Kevin M. Klughart, 14 Chapel St., Concord, NH (US) 03301

( * ) Notice: Subject to any disclaimer, the term of this patent is extended or adjusted under 35 U.S.C. 154(b) by 0 days.

(21) Appl. No.: 09/347,471

(22) Filed: Jul. 2, 1999

(Under 37 CFR 1.47)

Related U.S. Application Data

(60) Provisional application No. 60/092,465, filed on Jul. 11, 1998.

(51) Int. Cl.[7] ..... G08B 21/00

(52) U.S. Cl. ..... 340/679; 340/680; 340/686.1; 340/685; 340/425.5; 182/14; 182/148

(58) Field of Search ..... 340/679, 680, 340/825.25, 463, 464, 465, 686.1, 686.5, 685, 425.5; 182/2, 63, 14, 148

(56) References Cited

U.S. PATENT DOCUMENTS

| | | | | |
|---|---|---|---|---|
| D. 336,864 | | 6/1993 | Gottlieb . | |
| 3,818,438 | | 6/1974 | Stacha, Jr. . | |
| 4,013,996 | | 3/1977 | Hubbard . | |
| 4,171,114 | * | 10/1979 | Marden | 244/116 |
| 4,258,825 | * | 3/1981 | Collins | 182/14 |
| 4,511,015 | * | 4/1985 | Purdy | 182/2 |
| 5,132,665 | | 7/1992 | Hutchisson et al. . | |
| 5,262,757 | | 11/1993 | Hansen . | |
| 5,666,186 | * | 9/1997 | Meyerhoefer et al. | 396/281 |
| 5,740,887 | * | 4/1998 | Unger et al. | 187/231 |
| 6,140,930 | * | 10/2000 | Shaw | 340/685 |

* cited by examiner

*Primary Examiner*—Jeffery Hofsass
*Assistant Examiner*—Daniel Prévil
(74) *Attorney, Agent, or Firm*—Robert R Deleault, Esq.; Mesmer & Deleault, PLLC

(57) ABSTRACT

An aerialift warning system and method for use on aerialift equipment to warn the aerialift operator to fasten his/her safety lanyard and to warn persons within the zone of danger below the aerialift boom/basket of the impending danger posed by the descending boom/basket. The system includes a warning module and a speaker. The warning module includes a driver circuit for receiving a boom movement input signal and for asserting an up motion or down motion signal, and a processing circuit for receiving the up motion and down motion signal. The processing circuit contains an execution program to assert one or more warning messages contained in an audio warning circuit. The asserted one or more messages from the audio warning circuit are sent to a speaker.

36 Claims, 5 Drawing Sheets

AERIALIFT WARNING SYSTEM AND METHOD

This application claims the benefit of US Provisional Application No. 60/092,465, filed Jul. 11, 1998.

BACKGROUND OF THE INVENTION

1. Field of the Invention

The present invention relates generally to a warning system and method that provides a warning to people in the vicinity of the device that an action is occurring or will occur. Particularly, the present invention relates to an aerialift warning system and method that provides a warning to people in the vicinity of the device that an action is occurring or will occur. More particularly, the present invention relates to an aerialift warning system and method that provides a warning to an aerialift operator to attach the safety lanyard and to people standing or walking within the vicinity of an aerialift boom/basket attached to a truck used for performing maintenance on pole cabling, sign repair, and the like.

2. Description of the Prior Art

Aerialift booms are mechanical conveyances mounted on a parked and stationary vehicle which permit persons to be lifted in a basket vertically from an initial ground position for the purpose of performing maintenance on pole cabling, sign repair, and the like. Several problems associated with the use of aerialift booms are accidents that occur when the aerialift operator fails to fasten his lanyard to the aerialift boom/basket and when aerialift booms/baskets are moving. Aerialift operators have suffered serious injuries caused by falls from the aerialift basket when working suspended above the ground because they have forgotten to attach their safety lanyards. Others below a suspended aerialift boom/basket have been seriously injured when the suspended aerialift boom/basket moves downward.

Descending aerialift booms and baskets are hazardous to traffic control personnel and/or law enforcement officers who are often times present around the aerialift vehicle while work is being performed on electrical, telephone, CATV, or fire alarm systems. It is also hazardous to other employees and/or pedestrians who wander under and around the ground area surrounding the aerialift device. Much of the time an aerialift boom operator is working above the ground, he/she is naturally blinded to individuals below who wander beneath the aerialift boom. These potential accident victims have a threat attention space which is generally focused horizontally as a matter of natural tendencies, and as such these individuals are unaware of potential life-threatening dangers posed by the aerialift boom and/or aerialift basket.

The horizontal and vertical deployment of the aerialift presents special problems in protecting individuals under this device, since the range of danger associated with the aerialift boom basket can be quite large in both the horizontal and vertical directions. Typical deployment envelopes for aerialift devices have deployment ranges with vertical heights of 30 feet and horizontal deployment distances of 25 feet. This large deployment range means that any device used to warn individuals of the danger presented by the aerialift device must have characteristics different than conventional backup warning devices to be effective in this application, since the range of danger is much larger than for a conventional piece of construction equipment or the like.

Various prior art warning devices have been designed specifically for limited purposes. Signaling devices on vehicles to indicate that they are in a backward motion are well known in the art. Other devices have been designed for use as an audible warning for bicycles. However, the aerialift vehicle in most instances is parked and stationery with chock blocks on the rear wheels to assure that the vehicle remains in a secure, fixed position while the aerialift operator works aloft. There is no known prior art that solves the problems associated with injuries occurring from descending aerialift baskets or objects falling from these baskets.

U.S. Pat. No. 3,818,438 (1974, Stacha) teaches a tamper-proof backup electrical warning system for use on heavy vehicles. The device provides an audible signal to warn persons standing to the rear of a vehicle of backward movement of the vehicle. The electrical warning system has two flasher units and two signal circuits that can be selectively operated by a manual switch.

Several aspects of this invention make it inappropriate for use in aerialift applications. In the context of many aerialift applications, there exists the distinct possibility that many ground-based commercial vehicles will be moving in close proximity to the aerialift device. The problem here is that the Stacha device or a variant of it has been mandated by the Occupational Safety and Health Administration (OSHA) for use on most commercial vehicles. Thus, if an aerialift warning device used the same warning mechanism to indicate vertical threats, it is possible that this audible warning would be drowned out by the audible warnings of other commercial vehicles. This confusion could result in desensitization to the danger associated with the vertical aerialift threat.

U.S. Pat. No. 4,013,996 (1977, Hubbard) teaches a safety device which causes the signal indicator lights of a vehicle to flash on and off when the vehicle is being backed, thus providing a warning to pedestrians and other members of the driving public in the vicinity.

The problem with the Hubbard device as applied to aerialift applications is that unless the aerialift is operated at night, this warning is ineffectual to provide adequate notice to persons below the aerialift boom that there is an impending danger from above when the aerialift descends. In fact, during periods of bright sunlight, the Hubbard device would be ineffectual at providing any notice that there was an impending danger. The signal lights of the aerialift vehicle would in many cases be washed out by the bright ambient sunlight.

U.S. Pat. No. 5,132,665 (1992, Hutchisson et al.) teaches a self-powered backup alarm which is mounted to the wheel hub of a heavy truck or like vehicle. The alarm of this device is activated on the movement of the wheel hub when the truck moves in a backwards direction. The self-powered nature of the invention is useful in situations where a retrofit of the electrical wiring system to affect the functionality of the Hubbard invention would be prohibited. The Hutchisson device is not directly applicable to the aerialift application, because there is no moving wheel mechanism which would provide an activation means for the Hutchisson alarm. Furthermore, since the vehicle from which the aerialift boom is deployed is stationary, the triggering means required for the Hutchisson device is lacking in this instance.

U.S. Pat. No. 5,262,757 (1993, Hansen) teaches an electronic audible warning device which includes a power source, a motion detector, a pleasant tone generator, a loud piercing tone generator, and a remote push button activated switch. The signaling device provides two distinct features, each in response to remote activation by manual switch. A single depression on the remote push-button switch will sound a pleasant two second pulsating warning tone. Two consecutive depressions of the remote push-button switch will sound an attention-getting pulsating signal similar to the backup beeper on commercial trucks. The motion detector portion of the Hansen device is limited in scope to use as an anti-theft, anti-tampering device for the bicycle to which the alarm is attached.

As with previous patents, the Hansen device requires manual triggering of the alarm function. Key to the Hansen implementation is the fact that this alarm is designed to be placed in the front of a bicycle and triggered when the operator is aware of a potential accident victim. This scenario differs significantly from that of the aerialift application in which the operator may have no knowledge of a potential victim beneath the aerialift basket. In short, the Hansen device as well as the other prior art provides no means of providing warning in cases where the aerialift operator is unaware of the potential accident victim.

U.S. Pat. No. Des. 336,864 (1993, Gottlieb) describes a backup warning signal lamp fixture. This design patent does not disclose any functional features which might be applicable to the special needs of aerialift warning devices.

Therefore, what is needed is a warning device that provides an audible warning to individuals standing in proximity to an aerialift boom/basket when the basket is descending or moving in a vertical direction. What is further needed is a warning device that produces an audible warning which provides a specific indicia of the vertical nature of the danger present in proximity to the aerialift boom/basket and which is distinguishable from other OSHA-style backup warnings currently used within the construction industry. What is still further needed is a warning device that produces an audible warning which provides a specific indicia of the danger associated with a descending aerialift boom/basket and which provides a audible warning to individuals standing in proximity to an aerialift boom/basket when the basket is moving. What is yet further needed is a warning device that permits the use of multilingual safety messages (English, Spanish, French, etc.) to be emitted by a warning device which targets the zone of danger associated with the aerialift boom device. What is yet further needed is a warning device that reminds the aerialift operator to attach his/her safety lanyard to the boom/bucket.

SUMMARY OF THE INVENTION

It is an object of the present invention to provide an audible warning to individuals standing in proximity to an aerialift boom/basket when the basket is descending or moving in a vertical direction. It is a further object of the present invention to produce an audible warning which provides a specific indicia of the vertical nature of the danger present in proximity to the aerialift boom/basket and which is distinguishable from other OSHA-style backup warnings currently used within the construction industry. It is still a further object of the present invention to produce an audible warning which provides a specific indicia of the danger associated with a descending aerialift boom/basket and which provides a audible warning to individuals standing in proximity to an aerialift boom/basket when the basket is moving. It is yet a further object of the present invention to permit the use of multilingual safety messages (English, Spanish, French, etc.) to be emitted by a warning device which targets the zone of danger associated with the aerialift boom device. It is yet another feature of the present invention to provide the aerialift operator forewarning to attach his/her safety lanyard so that he/she is secured to the aerialift boom/bucket.

The present invention achieves these and other objectives by providing a warning device coupled to an aerialift boom device to emit warning messages when the aerialift operator engages the aerialift boom device for the first time and when the aerialift boom device is moving. Aerialift operators who fail to attach their safety lanyards place themselves at risk of serious injury should they fall from a suspended aerialift device. Descending aerialift booms and baskets are hazardous to traffic control personnel and/or law enforcement officers who are oftentimes present around the aerialift vehicle while work is being performed on electrical, telephone, CATV, or fire alarm systems. It is also hazardous to other employees and/or pedestrians who wander under and around the ground area surrounding the aerialift device. Much of the time an aerialift boom operator is working above the ground. He/she is naturally blinded to individuals below who wander beneath the aerialift boom. These potential accident victims have a threat attention space which is generally focused horizontally as a matter of natural tendencies, and as such these individuals are unaware of potential life-threatening dangers posed by the aerialift boom and/or aerialift basket.

For instance, law enforcement officers often are required to direct traffic within the vicinity of aerialift devices, and often wear wide brimmed hats while performing this function. This attire makes them susceptible to injury from overhead aerialift baskets. A typical injury mode is one in which the aerialift operator is concentrating on a task to be performed. The law officer is directing traffic, and the aerialift basket is blocking the view of the aerialift operator. This situation is ripe for the law enforcement officer sustaining a head injury from the aerialift basket.

Another safety issue present in this common situation is that road noise from traffic further masks the movement of the aerialift boom, and prevents both the law enforcement officer and the aerialift operator from noticing the presence of the other. The aerialift operator may lower the aerialift boom onto the top of the law enforcement officer's head, resulting in severe injury and possible paralysis. Such cases have been documented in the use of various aerialift boom devices. The degree of warning possible to both the aerialift operator and the law enforcement officer actually decreases the closer the aerialift boom comes to the law enforcement officer. This situation obviously represents a serious safety issue. Furthermore, it is possible for the aerialift danger to be present at a significant distance from the aerialift support truck/van due to the booms horizontal deployment capability. This further increases the potential that the law enforcement officer will be unaware of even the potential of an aerialift threat from above. Even construction personnel who wear proper safety gear are susceptible to injury from an aerialift boom. Many times a hard-hat or other hat or headgear is worn by people below which further handicaps their ability to see potential dangers above their position on the ground. Dress code requirements may dictate this attire despite the danger present in areas where aerialift devices are in use.

Due to the nature of typical aerialift basket operation, the aerialift basket operator is blind to a significant ground area directly beneath the aerialift basket. The basket in which he/she is standing creates a natural block to what is seen in the downward direction. To further compound this danger, a descending aerialift device is generally silent in its descent, creating a climate in which safety is generally based upon luck and circumstance. Furthermore, advances in safety equipment designed to protect the aerialift operator from electric shock hazards and from the weather by way of the use of basket enclosures may preclude a full view of the zone of danger beneath the aerialift basket.

The aerialift basket in many instances descends to the ground at a significant distance from the parked vehicle, further compounding the element of surprise. This is because even if ground personnel are aware of the aerialift boom danger in close proximity to the stationary aerialift deployment truck, this awareness decreases as the square of the distance to the truck. As such, the perceived danger rapidly decreases to the point that ground personnel become desensitized to the presence of the aerialift boom.

It should be noted that a wide variety of aerialift devices exist, having a wide range of horizontal and vertical deployment capabilities. The aerialift basket may be positioned several car/truck lengths from the stationary aerialift support structure, making the threat area posed by the boom and basket quite large. For example, a boom length of 30 feet provides for a zone of danger comprising more than 2800 square feet. Since the zone of danger surrounding the aerialift support vehicle is related to the square of the maximum boom length, the danger potential exists far beyond the scope of the boom platform itself.

The present invention is a warning system for an aerialift apparatus that will deliver a variety of warnings, (1) reminding the aerialift operator to attach his safety lanyard the first time the boom is operated and (2) warning anyone in the path of the aerialift to be cautious and stand clear of the danger an aerialift apparatus that it is present and moving downward. This device would be activated whenever the aerialift operator begins any motion of the aerialift apparatus by way of the aerialift movement controls. Incorporation of visual warnings may also be incorporated with this apparatus, as well as limiting warnings to situations in which the aerialift boom is only descending.

The truck to which the aerialift device is mounted is generally parked and chock blocked in a stationary position. The present invention provides warning to people below who are in range of the reach of the boom, that a dangerous collision is potentially imminent from a blind area above the potential victim. The vehicle to which the aerialift apparatus is mounted may be parked and stationary with the rear wheel chucked for safety with cones near the vehicle. This scenario does not represent a clear and present danger to most pedestrians, as the vehicle itself seems secure and safely parked. Most people are not aware that the danger lurks inconspicuously from above. Even lineman with years of experience are often preoccupied and take for granted the danger from above. Additionally, aerialift operators often falsely assume that persons below the aerialift basket are aware of the danger and will clear the area as the aerialift basket moves or descends towards the ground.

The present invention solves these particular problems by providing an audible alarm which distinctly indicates a vertical threat of an overhead aerialift boom. This is accomplished by the use of a submarine klaxon signal or the like emanating from the aerialift boom/basket to indicate the distinctly vertical nature of the danger presented by the aerialift basket. This klaxon alarm may be optionally augmented with automated speech which is vocalized in a variety of languages to distinctly point out the danger present above the potential victim. Various embodiments of the present invention position a loudspeaker coincident with the aerialift boom movement to saturate the zone of danger with a suitable audible warning message.

Although the following feature is not an active component of the present invention, the present invention may be adapted in the future to provide an optional asynchronous alarm triggering mechanism which permits triggering of automated speech warnings should any person wander beneath the danger zone associated with the aerialift basket. This automated warning mechanism permits the danger presented by falling objects from the aerialift basket to be avoided by pedestrians and the like, while simultaneously warning the aerialift operator that there are potential accident victims beneath the aerialift basket. While a wide variety of motion detection methods are suitable for this application, the present invention specifically envisions the use of infrared and/or ultrasonic motion detection technologies as a means for implementing this motion detection function.

The present invention incorporates a 7-channel Darlington driver circuit, a programmable microcomputer circuit, an audio circuit that is capable of storing up to 20 seconds of voice quality audio, an audio amplifier circuit, a low dropout voltage regulator circuit, and at least one speaker. The driver circuit receives inputs from the aerialift boom control unit and provides an output voltage and current that is compatible with the programmable microcomputer circuit. The programmable microcomputer circuit is a self-contained microcomputer. Its program is contained in an on-chip PROM. The program basically determines whether the boom is moving up or down, and plays an appropriate warning message. An on-chip internal clock oscillator allows the use of all signal pins for I/O (input/output) and eliminates the need for external resistor/capacitor (R/C) or crystal oscillator components. The inputs include the "up and down" motion signals from the boom, the "busy" signal from the audio circuit, and fault indicator signals from the stereo amplifier circuit. The outputs include signals to the audio circuit, and mute and power down signals to the audio amplifier.

The audio signal of the audio circuit can be broken down into as many as eight individual "phrases" which are played on demand by asserting one or two of the four switch inputs. The programmable microcomputer circuit enables a phrase as required by asserting the appropriate switch input of the audio circuit. While the phrase is playing, the audio circuit asserts a "busy" output letting the programmable microcomputer circuit know when the play has completed. The programmable microcomputer circuit can abort the currently playing phrase by asserting the audio circuit's interrupt playback input. The audio circuit converts sounds from their digital format to both linear and pulse-width modulated outputs.

The audio amplifier circuit takes a linear voltage input from the audio circuit and converts it to a pulse-width modulated signal by comparing the input to an internal sawtooth reference waveform. The sawtooth runs at approximately 100 KHz to allow sufficient bandwidth for audio (up to 20 KHz) while simplifying the filter design for the speaker outputs. The balanced output drive allows connection to the speaker without series coupling capacitors. Several components, coils and capacitors, form a second order Butterworth low-pass filter at the amplifier outputs at approximately 30 KHz. This low-pass filter sufficiently filters out the 100 KHz switching frequency while allowing the full audio range of the frequencies to pass through to the speaker.

The voltage regulator circuit supplies five volts DC to the remaining circuitry of the present invention at up to five amperes peak. When the audio amplifier is shut down, the present invention draws only a few milliamperes at 5 volts. The voltage regulator circuit uses about 10 milliamperes, most of which flows through the feedback voltage divider.

The present invention operates in conjunction with the aerialift boom movement. At boom idle, the audio amplifier is on shutdown and muted. When the driver circuit receives a signal from the aerialift boom control unit, the program of the programmable microcomputer circuit determines whether boom motion is up or down. If an up signal is detected, the program then determines if it is the first up motion. If it is the first up motion, then the entire "up message" is played. The system announces "attach lanyard" or such other relevant message. This reminds the aerialift operator to check that his/her safety lanyard is attached. After first enablement, the present invention does not make the "attach lanyard" statement again unless the aerialift boom has been lowered for at least three seconds.

If a down motion signal is detected, when one second has elapsed the present invention will play the "down message." The message should announce "Arooogah, clear the area below" or other such message to notify persons within the zone of danger below that the aerialift boom and basket is being lowered. The message should continue to play until the down motion signal ceases; that is the "down" button on the aerialift control unit is released. As stated above, any down motion continuing for longer than three seconds, enables the "first up" message indicator.

DETAILED DESCRIPTION OF THE PREFERRED EMBODIMENT

Figure 1:
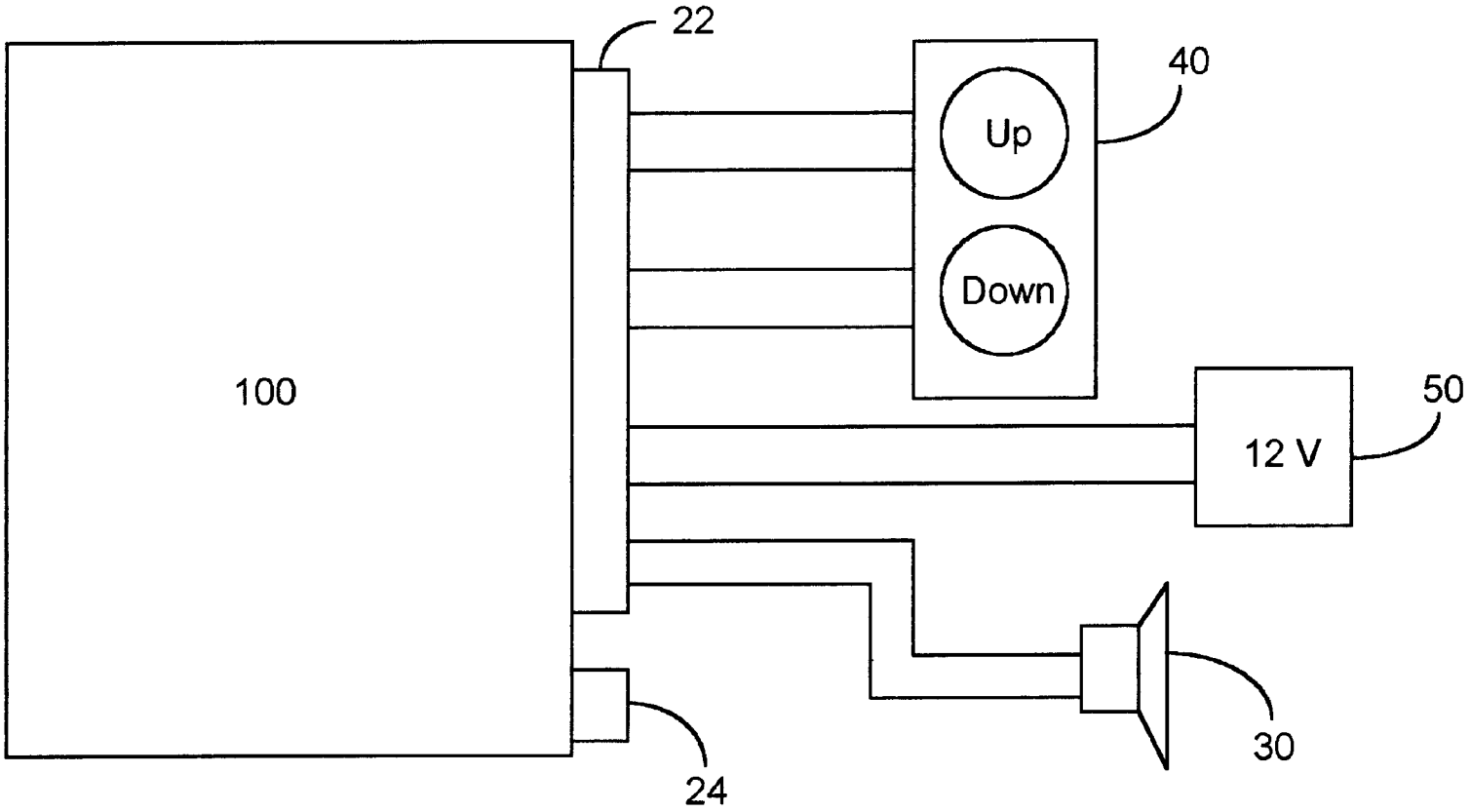
FIG. 1 is a simplified block diagram of the present invention showing an aerialift warning system.

The preferred embodiment of the present invention is illustrated in FIGS. 1–4. An aerialift warning system 10 illustrated in FIG. 1 includes an warning module 100, an interface device 22, a language selector switch 24, and a speaker device 30. A boom movement control 40 and power source 50 represent the existing controls on an aerialift boom/basket and the aerialifts 12 Volt power supply, respectively.

Figure 2:
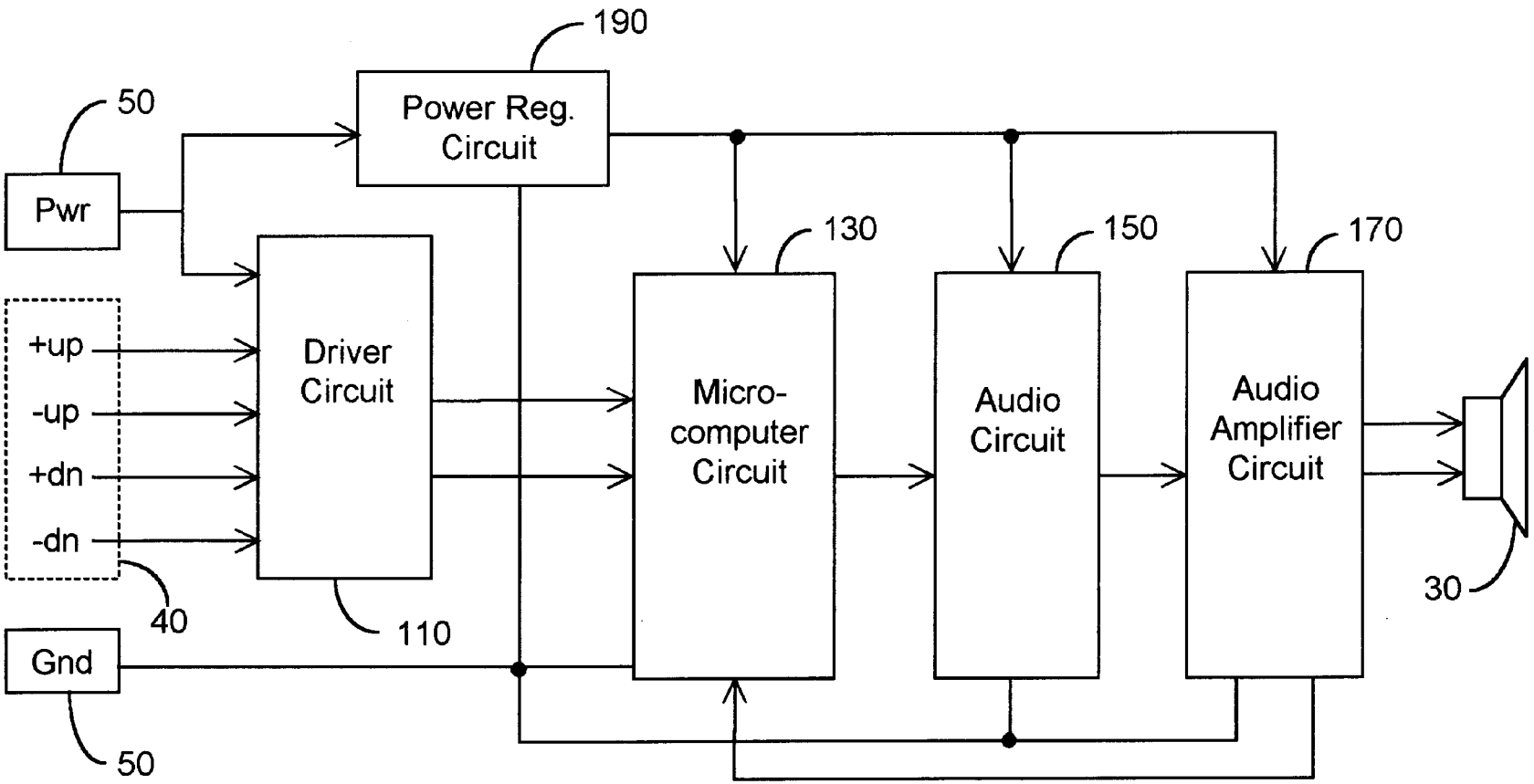
FIG. 2 is a simplified block diagram of the present invention showing the warning apparatus of the aerialift warning system.

Referring now to FIG. 2, the warning module 100 further includes a driver circuit 110, a programmable microcomputer circuit 130, an audio circuit 150, an audio amplifier circuit 170, and a power regulator circuit 190. The driver circuit 110 is a 7-channel Darlington driver circuit. The driver circuit 110 provides an up signal and a down signal to the microcomputer circuit 130. The microcomputer circuit 130 contains a program embedded in memory in the microcomputer circuit 130, illustrated in FIG. 4 as a flow block diagram and which will be discussed later. Upon receiving the signals from driver circuit 110, the program determines which message is to be played and sends output signals to the audio circuit 150. The audio circuit 150 issues a message signal, which is converted from the internal stored digital format to both linear and pulse-width modulated outputs. The audio message signal is received by the audio amplifier circuit 170 which converts a linear voltage input to a pulse-width modulated signal by comparing the input to an internal sawtooth reference waveform. The audio amplifier circuit 170 provides a balanced output drive to the speaker 30. The power regulator circuit 190 receives power from the aerialift truck's 12 Volt DC system, converts the +12 Volts DC to +5 Volts DC and provides a constant +5 Volt DC power source to the other components of warning module 100.

Figure 3A:
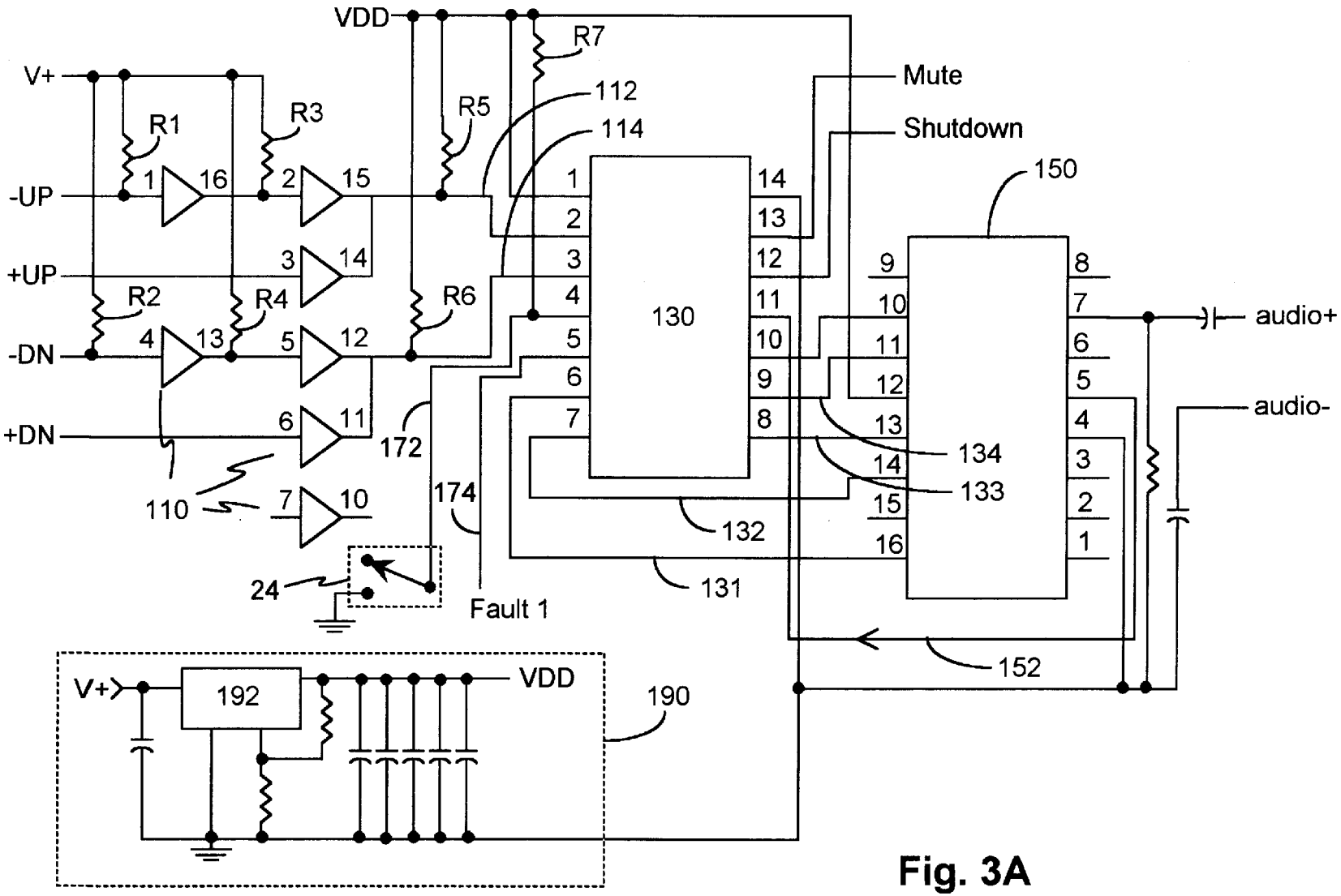
FIGS. 3A and 3B are a circuit diagram illustrating the warning apparatus for the preferred warning device.

Referring now to FIG. 3A, power V+ from the aerialift truck is supplied to the warning module 100. Power regulator circuit 190 includes a voltage regulator 192 for receiving V+ and supplying a constant +5 volts (VDD) to power microcomputer circuit 130, audio circuit 150, audio amplifier circuit 170, and one side of driver circuit 110. A device suitable for use as the voltage regulator 192 is available as Voltage Regulator Model LT1585A, a product of Linear Technologies. Driver circuit 110 is a 7-channel Darlington driver circuit, available from SGS Thomson, Toshiba and Allegro Microsystems. A device suitable for use as driver circuit 110 is available from Digikey, Thief River Falls, Minn., as Toshiba Model ULN2004A. The integrated resistors (not shown) in this particular model guarantees that the output will be off when no input signal from boom movement control 40 is received. High input threshold voltage assures greater noise immunity when using external diodes in series with inputs.

The discreet resistors R1, R2, R3, and R4 are used as input pull-ups for the negative-true inputs (i.e. to turn on the circuit when there is no input) and as output pull-ups on all circuits. The outputs of the Darlington driver can only pull down. Drivers connected together thus form a positive true AND gate or a negate true OR gate. In this circuit, they effectively OR the condition of the negative and positive inputs such that when either a negative input is low or the associated positive input is high, the output drives low, indicating boom motion. While the Darlington driver circuit has a relatively high output low voltage when driving at rated current, use of resistors R5 and R6 (which are 56K resistors) allows the "down" transistor to saturate even if the "upper" transistor is not conducting. Thus, the output low voltage at this low current is compatible with the inputs of microcomputer circuit 130.

The resulting driver circuit output signal is provided to microcomputer circuit 130. Microcomputer circuit 130 generally includes an up motion input terminal and a down motion input terminal illustrated as up signal lead 112 and down signal lead 114, respectively. The microcomputer circuit 130 is a self-contained microcomputer which contains a program in on-chip PROM. The program, which is easily written by those skilled in the art, performs the typical operations of the present invention. An on-chip internal clock oscillator allows the use of all signal pins for input and output and eliminates the need for external resistor/capacitor or crystal oscillator components. Inputs to the microcomputer circuit 130 includes the up signal lead 112, the down signal lead 114, a busy signal lead 152, a language selector switch lead 172 and fault indicator lead 174. Outputs include audio selection leads 131, 132, 133, and 134 to the audio circuit 150, and the mute lead 135 and power down lead 136 to audio amplifier circuit 170. A device suitable for use as a microcomputer circuit 130 is a Microchip product Model PIC16C505 also available from Digikey.

The resulting computer circuit signals are provided to audio circuit 150. Audio circuit 150 generally includes four input terminals illustrated as audio selection leads 131, 132, 133, and 134. The audio circuit 150 is an instant voice ROM chip. It stores up to 20 seconds of voice quality audio in its internal PROM. The audio can be broken into as many as 8 individual "phrases" which are played on demand by asserting one or two of the four inputs. The present invention currently stores four phrases, two each in Spanish and English. While a phrase is playing, the audio circuit 150 asserts the busy signal lead 152 letting the microcomputer circuit 130 know when the play has completed. The microcomputer circuit 130 can abort the currently playing phrase by asserting the interrupt playback terminal illustrated as audio selection lead 131 of audio circuit 150. The audio circuit 150 converts sounds from their internal digital format to both linear and pulse-width modulated outputs. A device suitable for use as an audio circuit 150 is an ISSI product Model IS22C020 Instant Voice ROM chip also available from Digikey.

Figure 3B:
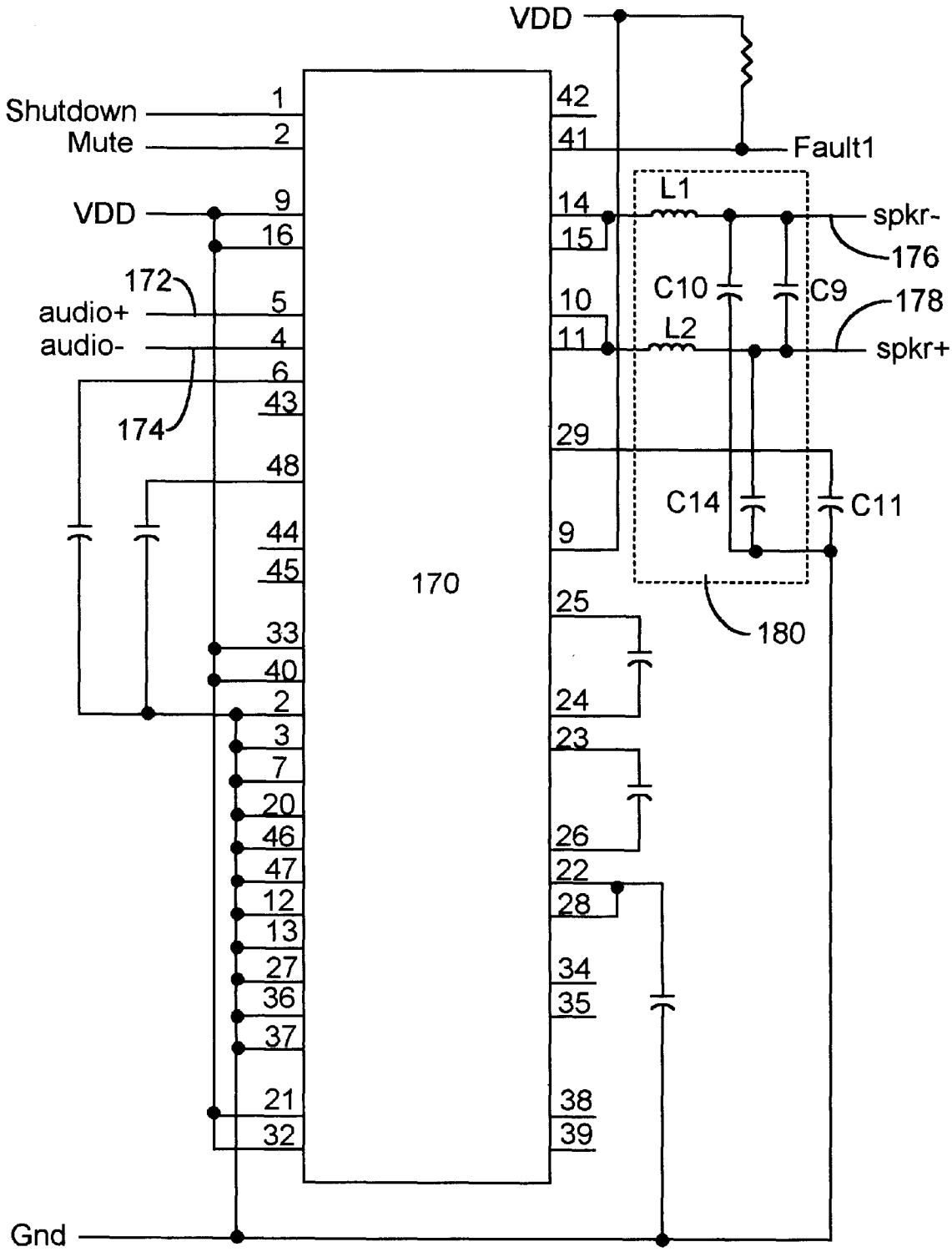

The resulting linear output from the audio circuit 150 is provided to audio amplifier circuit 170, illustrated in FIG. 3B. Audio amplifier circuit 170 includes an audio input terminal illustrated as audio input lead 172 and 174 and two speaker output terminals illustrated as speaker output lead 176 and 178. The audio amplifier circuit 170 is a stereo class D (pulse-width modulated) amplifier. The present invention only uses one channel of this amplifier. The amplifier circuit 170 takes a linear voltage input and converts it to pulse-width modulation by comparing the input to an internal sawtooth reference waveform. The sawtooth runs at approximately 100 KHz to allow sufficient bandwidth for audio (up to 20 KHz) while simplifying the filter design for the speaker outputs. The pulse-width modulated signals drive an H-bridge MOSFET output stage. The balanced output drive allows connection of the speaker without series coupling capacitors. Components L1, L2, C9, C10, and C14 form a second order Butterworth low-pass filter 180 at approximately 30 KHz. This sufficiently filters out the 100 KHz switching frequency while allowing the full audio range of frequencies to pass through to the speaker. A device suitable for use as an audio amplifier circuit 170 is available as a Texas Instruments product Model TPA005D02 audio amplifier.

Figure 4:
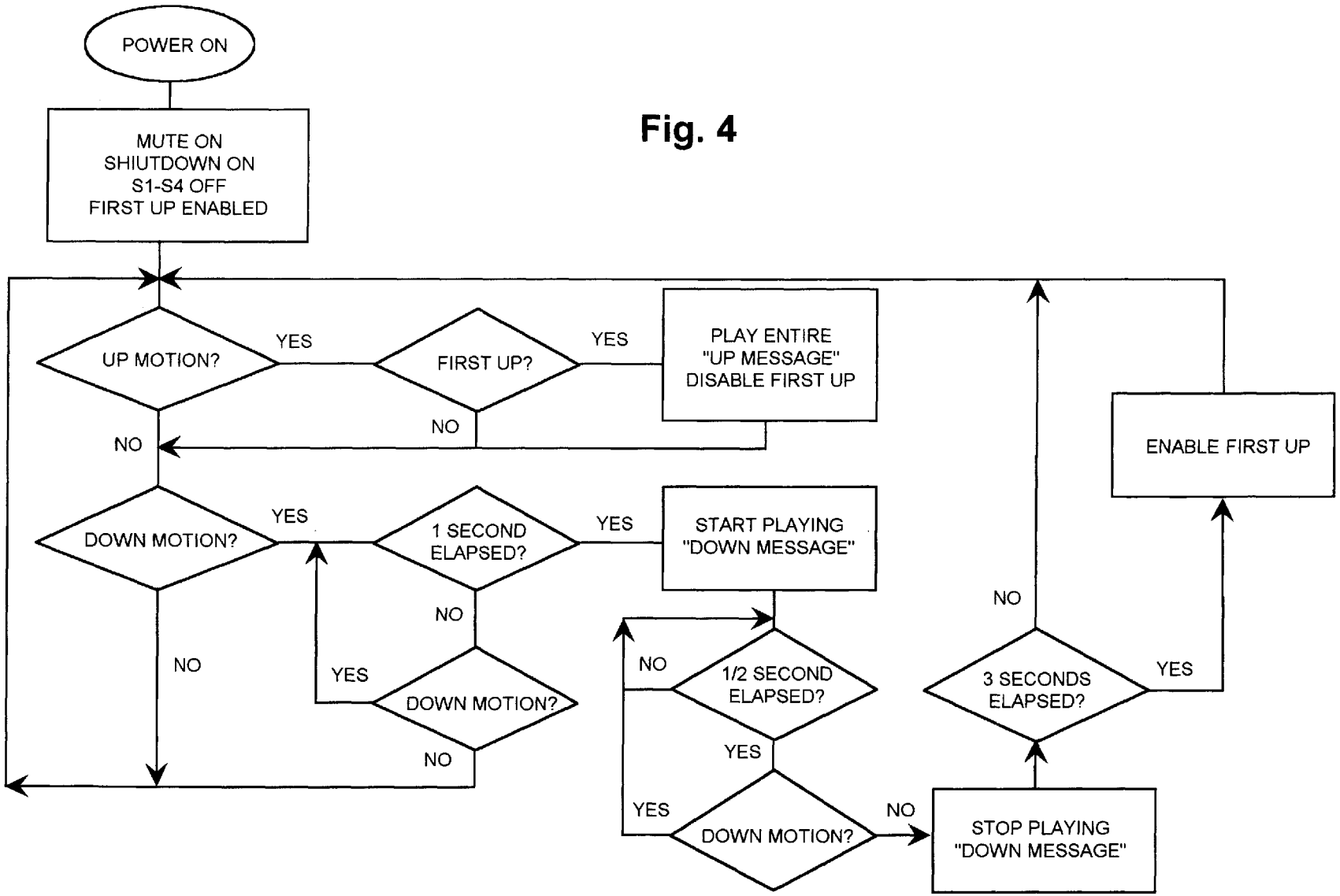
FIG. 4 is a block diagram of the present invention showing the activation sequence and execution of tasks for the preferred warning device.

FIG. 4 is a flow chart illustrating the typical operation of the present invention as an aerialift warning apparatus for use on an aerialift. To use the present invention, a user or installer connects an embodiment of the present invention to an aerialift system generally by locating the warning module 100 in a protected area within the aerialift truck in an area accessible to the wiring for the 12 volt power source and the boom up and down wires, and by locating the speaker on the boom, the basket or in any other location that will provide sufficient audible warnings to persons within the vicinity of the aerialift boom. After initial installation, the mute and shutdown features of the audio amplifier circuit 170 are enabled, the four audio selection terminals are disabled and the "first up" state is enabled. When a signal is received from the boom movement control 40, the program determines whether the signal received is for up motion or down motion. If the signal is from the "up motion" control then the "first up" state is checked. If "first up" is enabled, the entire up message is played. The message states "Fasten your lanyard." After playing, the "first up" state is disabled. The "first up" state becomes enabled only after the "down motion" control is used for more than 3 seconds. As illustrated in FIG. 4, if the aerialift operator moves the boom upward and stops, for example to perform some work on one section of a cable line or the like, and then moves upward again to a second, higher position, the program cycles through the "up motion" subroutine, illustrated as reference 210. The up message is not played because the "first up" state is still disabled.

When the aerialift operator lowers the boom, a down signal is asserted and execution of the program enters the "down motion" subroutine, illustrated as reference 220. For very short downward movements, typically less than one second, no messages are broadcast. An on-chip internal clock provides the timing mechanism for determining how long the down signals are asserted. As illustrated by FIG. 4, if the down signal is asserted for more than one second, program execution enter subroutine 220 and the down message is broadcast. The message includes the sounding of a klaxon similar to "Arooogah" followed by the statement "clear the area below." The message continues to play so long as the down signal is still being asserted, i.e. the boom continues its downward motion. At every one-half second, the program checks to see if the down signal is still being asserted. If so, the down message continues to repeat. When the down signal is no longer asserted, the down message stops playing. At the conclusion of the down message play, the total time elapsed during down signal assertion is checked. If the down signal assertion time is greater than three seconds, the "first up" state is enabled. The "first up" state is enabled because the warning module 100 assumes that the boom has been lowered and that the aerialift operator may have detached the safety lanyard and exited the boom basket/bucket. It is obvious by those skilled in the art that the enablement time may be greater or lesser than disclosed and that the wording of the messages do not have to be exactly as stated above. The messages may have many variations provided that the intended warnings are sufficiently conveyed to persons within the zone of danger of the aerialift boom and basket.

Although the preferred embodiment of the present invention has been described herein, the above description is merely illustrative. Further modification of the invention herein disclosed will occur to those skilled in the respective arts and all such modifications are deemed to be within the scope of the invention as defined by the appended claims.

What is claimed is:

1. An aerialift warning system for an aerialift basket containing a human operator comprising:

an aerialift boom movement input;

a warning module for receiving and processing said aerialift boom movement input; and an output signal generated by said warning module, said output signal containing a predefined audio warning signal which provides a specific indicia of the danger associated with the downward movement of said aerialift basket, said predefined audio warning signal being sufficiently audible to saturate the zone of danger of said aerialift basket.

2. An aerialift warning system of claim 1 wherein said warning module comprising:

a boom movement driver circuit for detecting a boom movement signal from said aerialift boom movement input;

a microcomputer circuit for receiving a driver circuit output signal from said boom movement driver circuit;

an audio warning circuit for receiving a microcomputer output signal from said microcomputer circuit and for outputting a predetermined audio warning signal; and a power regulating circuit for providing a constant voltage output power to said boom movement driver circuit, said microcomputer circuit, said audio warning selection circuit and said audio amplifier circuit.

3. The system of claim 2 wherein said audio warning circuit further includes an audio warning selection circuit for receiving said microcomputer output signal and for automatically selecting said predetermined audio warning signal, and an audio amplifier circuit for receiving and amplifying said predetermined audio warning signal from said audio warning selection circuit and outputting an amplified audio signal.

4. The system of claim 3 wherein said system further includes a speaker for receiving said amplified audio signal.

5. The system of claim 4 wherein said speaker is an all-weather speaker.

6. The system of claim 4 wherein said speaker is directed toward a zone of danger below an aerialift boom basket.

7. The system of claim 2 wherein said boom movement driver circuit has integrated resistors selected to assure that said driver circuit output signal is enabled only when said boom movement signal is received.

8. The system of claim 2 wherein said driver circuit output signal is comprised of a driver circuit up motion signal and a driver circuit down motion signal.

9. The system of claim 7 wherein said boom movement driver circuit has matching resistors, one on each of said driver circuit up motion signal and said driver circuit down motion signal.

10. The system of claim 2 wherein said microcomputer circuit has an internal clock oscillator.

11. The system of claim 2 wherein said audio warning selection circuit has sufficient memory for storing voice quality audio.

12. The system of claim 11 wherein said audio warning selection circuit has sequenced warning messages.

13. The system of claim 12 wherein said sequenced warning messages further comprises a klaxon alarm warning.

14. The system of claim 12 wherein said sequenced warning messages further comprises an audible speech warning.

15. The system of claim 12 wherein said sequenced warning messages further comprises a klaxon alarm warning followed by an audible speech warning.

16. The system of claim 12 wherein said sequenced warning messages are in at least one foreign language other than English.

17. An aerialift warning system for an aerialift boom/basket containing a human operator comprising:

aerial movement means for detecting aerialift boom/basket movement and asserting a resultant boom/basket movement signal;

processing means for receiving said boom/basket movement signal and selecting one or more warning messages; and an output signal means for outputting said one or more warning messages which provide a specific indicia of the danger associated with the downward movement of said aerialift boom/basket, said one or more warning messages being sufficiently audible to saturate the zone of danger of said aerialift boom/basket.

18. The system of claim 17 wherein said processing means further includes a detection means for receiving said boom movement signal and asserting a warning selection signal, and a warning activation means for receiving said warning selection signal and for activating warning modes in response to said aerial movement means.

19. The system of claim 17 wherein said output signal means further includes a warning amplifying means for amplifying said one or more warning messages.

20. The system of claim 19 wherein said warning amplifying means further includes an H-bridge MOSFET circuit connected to the output of said amplifier circuit.

21. The method of claim 20 further comprising determining if said one or more up messages are enabled and if enabled then disabling said one or more up messages after playing said one or more up warning messages.

22. The method of claim 21 further comprising enabling said one or more up warning messages when said down motion signal continues for a predetermined time period.

23. The method of claim 22 further comprising enabling said one or more up warning messages when said down motion signal continues for at least three seconds.

24. The system of claim 17 wherein said output signal means further comprises a speaker.

25. The system of claim 24 wherein said speaker is an all-weather speaker.

26. The system of claim 17 wherein said warning generating means further includes an amplifier circuit.

27. The system of claim 17 wherein said one or more warning messages further comprises an audible speech warning.

28. The system of claim 17 wherein said one or more warning messages further comprises a klaxon alarm warning.

29. The system of claim 17 wherein said one or more warning messages are sequenced warning messages comprising a klaxon alarm warning followed by an audible speech warning.

30. The system of claim 17 wherein said one or more warning messages are in at least one foreign language other than English.

31. An aerialift warning method for an aerialift basket containing a human operator comprising:

receiving a boom movement signal when a boom movement control is activated;

determining if said boom movement signal is an up motion signal or a down motion signal;

issuing one or more up warning messages when said boom movement signal is said up motion signal; and issuing one or more down warning messages which provide a specific indicia of the danger associated with the downward movement of said aerialift basket when said boom movement signal is said down motion signal, said one or more down warning messages being sufficiently audible to saturate the zone of danger of said aerialift basket.

32. The method of claim 31 wherein said boom movement determining step further comprising determining the time elapsed while said down motion signal is occurring.

33. The method of claim 32 further comprising issuing said one or more down messages when said elapsed time is equal to or greater than a predetermined time period.

34. The method of claim 33 wherein said elapsed time is at least one second.

35. The method of claim 33 wherein said down message issuing step further includes determining the message play time elapsed after the start of the said one or more down messages.

36. The method of claim 33 further includes stopping the issuance of said one or more down messages when said down motion signal terminates.

* * * * *